US010566725B2

(12) United States Patent
Ochiai

(10) Patent No.: US 10,566,725 B2
(45) Date of Patent: Feb. 18, 2020

(54) CONNECTOR WITH LATERALLY MOUNTED RETAINER FOR SUPPORTING AND LOCKING A TERMINAL FITTING

(71) Applicant: Sumitomo Wiring Systems, Ltd., Yokkaichi, Mie (JP)

(72) Inventor: Wataru Ochiai, Mie (JP)

(73) Assignee: Sumitomo Wiring Systems, Ltd. (JP)

( * ) Notice: Subject to any disclaimer, the term of this patent is extended or adjusted under 35 U.S.C. 154(b) by 136 days.

(21) Appl. No.: 15/876,379

(22) Filed: Jan. 22, 2018

(65) Prior Publication Data

US 2018/0248293 A1 Aug. 30, 2018

(30) Foreign Application Priority Data

Jan. 24, 2017 (JP) ..... 2017-009950

(51) Int. Cl.
*H01R 13/426* (2006.01)
*H01R 13/436* (2006.01)

(52) U.S. Cl.
CPC ..... *H01R 13/426* (2013.01); *H01R 13/4361* (2013.01)

(58) Field of Classification Search
CPC ..... H01R 13/426; H01R 13/4226; H01R 13/4361; H01R 13/4362; H01R 13/4223
See application file for complete search history.

(56) References Cited

U.S. PATENT DOCUMENTS 7,281,961 B1 * 10/2007 Sugiyama ..... H01R 13/113 439/595
2003/0224656 A1 12/2003 Yoshida
2013/0288542 A1 * 10/2013 Zheng ..... H01R 13/4223 439/744
2015/0038022 A1 * 2/2015 Kataoka ..... H01R 13/426 439/752

* cited by examiner

*Primary Examiner* — Amy Cohen Johnson
*Assistant Examiner* — Paul D Baillargeon
(74) *Attorney, Agent, or Firm* — Gerald E. Hespos; Michael J. Porco; Matthew T. Hespos

(57) ABSTRACT

A connector housing (10) includes a terminal inserting portion (15) into which deflectable locking lances (23) project, and a retainer mounting hole (26) communicating with the terminal inserting portion (15) and open in one surface facing in a direction intersecting an inserting direction of a terminal fitting (70). A retainer (40) is inserted into the retainer mounting hole (26). The retainer (40) includes a deflection restricting portion (44) configured to restrict the deflection of the locking lance (23) by entering a deflection space (58) for the locking lance (23) with the retainer (40) inserted to a proper depth in the retainer mounting hole (26) and supports (43) capable of supporting the terminal fitting (70) by being located to be able to come into contact with the terminal fitting (70).

4 Claims, 13 Drawing Sheets

CONNECTOR WITH LATERALLY MOUNTED RETAINER FOR SUPPORTING AND LOCKING A TERMINAL FITTING

BACKGROUND

Field of the Invention

The invention relates to a connector.

Description of the Related Art

US 2003/224656 A1 (FIG. 9) discloses a connector housing with a connector accommodation chamber and a deflectable locking lance that projects into the connector accommodation chamber. A terminal connected to a coaxial cable is inserted into the connector accommodating chamber and is locked primarily by the locking lance. A retainer mounting opening opens in a side surface of the connector housing to intersect and communicate with the connector accommodation chamber. A retainer is inserted into the retainer mounting opening in a position for restricting displacement of the locking lance and achieving a secondary retention of the terminal.

The front end of the above-described terminal includes a relatively large tubular body. A stabilizer projects laterally from the terminal and into a guide groove of the connector housing for supporting the stabilizer and restricting a tilt of the tubular body toward the locking lance. However, the guide groove is recessed on an inner wall of the connector accommodation chamber and an interference avoiding groove also is recessed on the retainer to restrict tilt of the tubular body and to allow passage of the stabilizer. Hence, the structure is complicated.

The invention was completed on the basis of the above situation and aims to provide a connector capable of supporting a terminal fitting inserted into a connector housing by a relatively simple structure.

SUMMARY

The invention is directed to a connector with a connector housing including a terminal inserting portion into which a terminal fitting is inserted. A deflectable locking lance projects from the connector housing into the terminal inserting portion and is configured to lock the terminal fitting. A retainer mounting hole is open in a surface of the connector housing facing a direction that intersects an inserting direction of the terminal fitting and communicates with the terminal inserting portion. A retainer is inserted into the retainer mounting hole and includes a deflection restricting portion that enters a deflection space for the locking lance when the retainer is inserted to a proper depth. The deflection restricting portion is configured to restrict deflection of the locking lance. A support is configured to contact and supporting the terminal fitting.

The retainer is inserted through the opening in the surface of the connector housing and is advanced to a proper depth in the retainer mounting hole. Thus, the deflection restricting portion enters the deflection space for the locking lance to restrict the deflection of the locking lance and to retain the terminal fitting secondarily. Further, the support of the retainer that has been inserted to a proper depth contacts and supports the terminal fitting and prevents the terminal fitting from tilting toward the locking lance. The support can reach a position to support the terminal fitting as the retainer is assembled. No special structure is required for the connector housing and the entire structure need not be complicated.

Two of the supports may be arranged at both sides of the deflection restricting portion and can support the terminal fitting from the both sides. According to this configuration, the terminal fitting is supported stably from the both sides.

The retainer may be movable with respect to the connector housing to a partial locking position where the retainer is inserted shallowly in the retainer mounting hole and a full locking position where the retainer is inserted to a proper depth in the retainer mounting hole. The two supports may include supporting surfaces at positions slightly higher than the deflection restricting portion, and steep wall surfaces extend to the supporting surfaces from a side where the deflection restricting portion is located. The deflection space for allowing the deflection of the locking lance at the partial locking position may be ensured between the wall surfaces of the supports, and the deflection of the locking lance may be guided by the wall surfaces. According to this configuration, the deflection of the locking lance is guided by the supports and the terminal fitting is retained and locked properly by the locking lance. Further, a dedicated lance guiding structure is not necessary, and therefore the structure can be simplified.

A groove may be formed on an outer surface of the terminal fitting, and the support may be fit into the groove to restrict a displacement of the terminal fitting in the inserting direction when the retainer is inserted to the proper depth into the retainer mounting hole. Accordingly, the supports will support the terminal fitting stably in the terminal inserting portion.

The connector housing may include a cavity for receiving a small terminal that is smaller than the terminal fitting. The retainer mounting hole may also communicate with the cavity, and the retainer may include a retaining portion configured to retain and lock the small terminal when the retainer is inserted to the proper depth in the retainer mounting hole. Accordingly, the terminal fitting and the small terminal are retained by the common retainer. As a result, it is not necessary to provide separate retainers corresponding respectively to the terminal fitting and the small terminal, and the structure can be further simplified.

DETAILED DESCRIPTION

An embodiment of the invention is described on the basis of the drawings. A connector according to this embodiment includes a connector housing 10, a retainer 40, a terminal fitting 70 and small terminals 90. The connector housing 10 is connectable to an unillustrated mating connector housing. Note that, in the following description, a surface side facing the mating connector housing when the connection of the connector housing 10 is started is referred to as a front side concerning a front-rear direction and a vertical direction is based on each figure except FIGS. 10 and 14.

Figure 7:
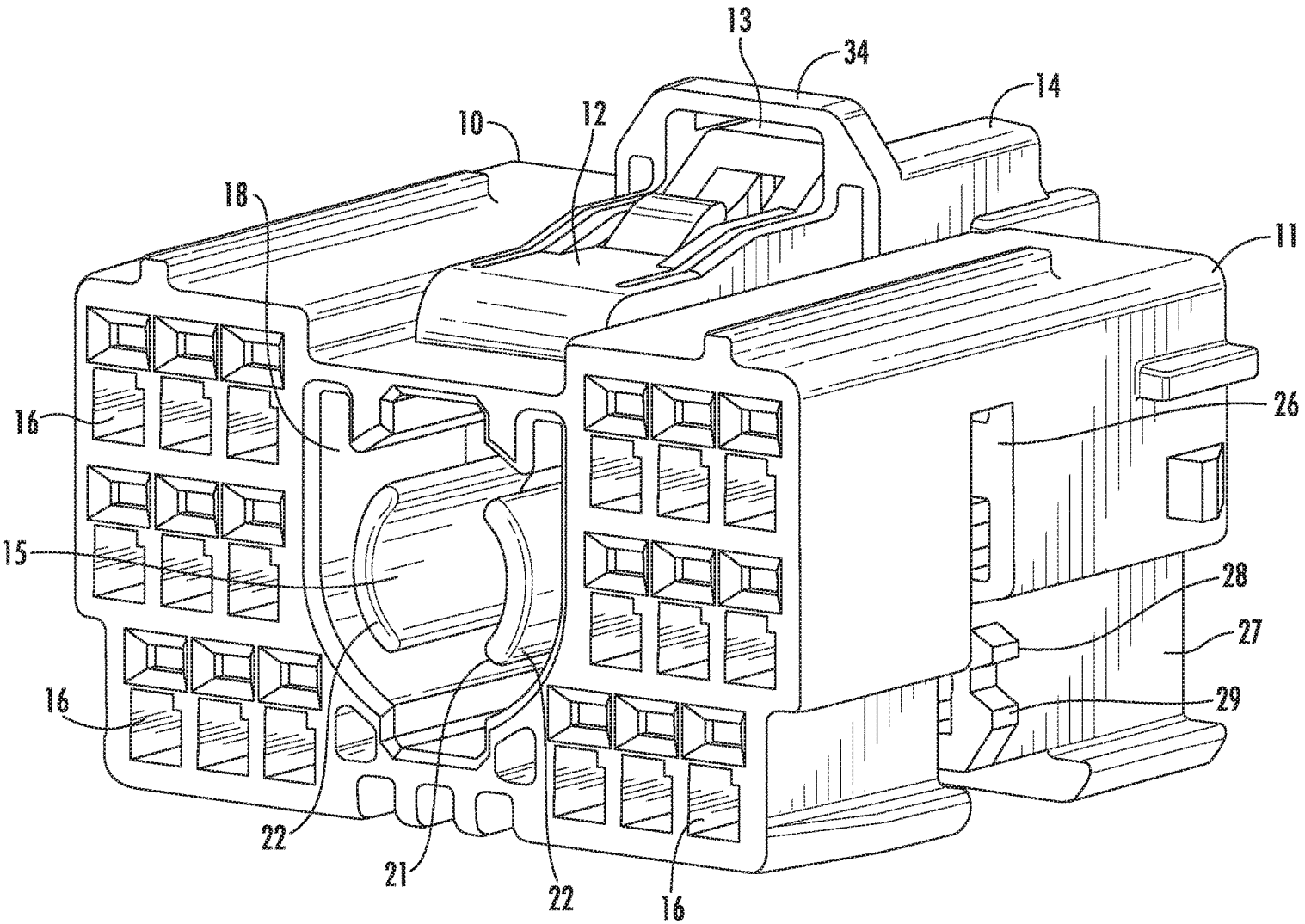
FIG. 7 is a perspective view of the connector housing.
Figure 8:
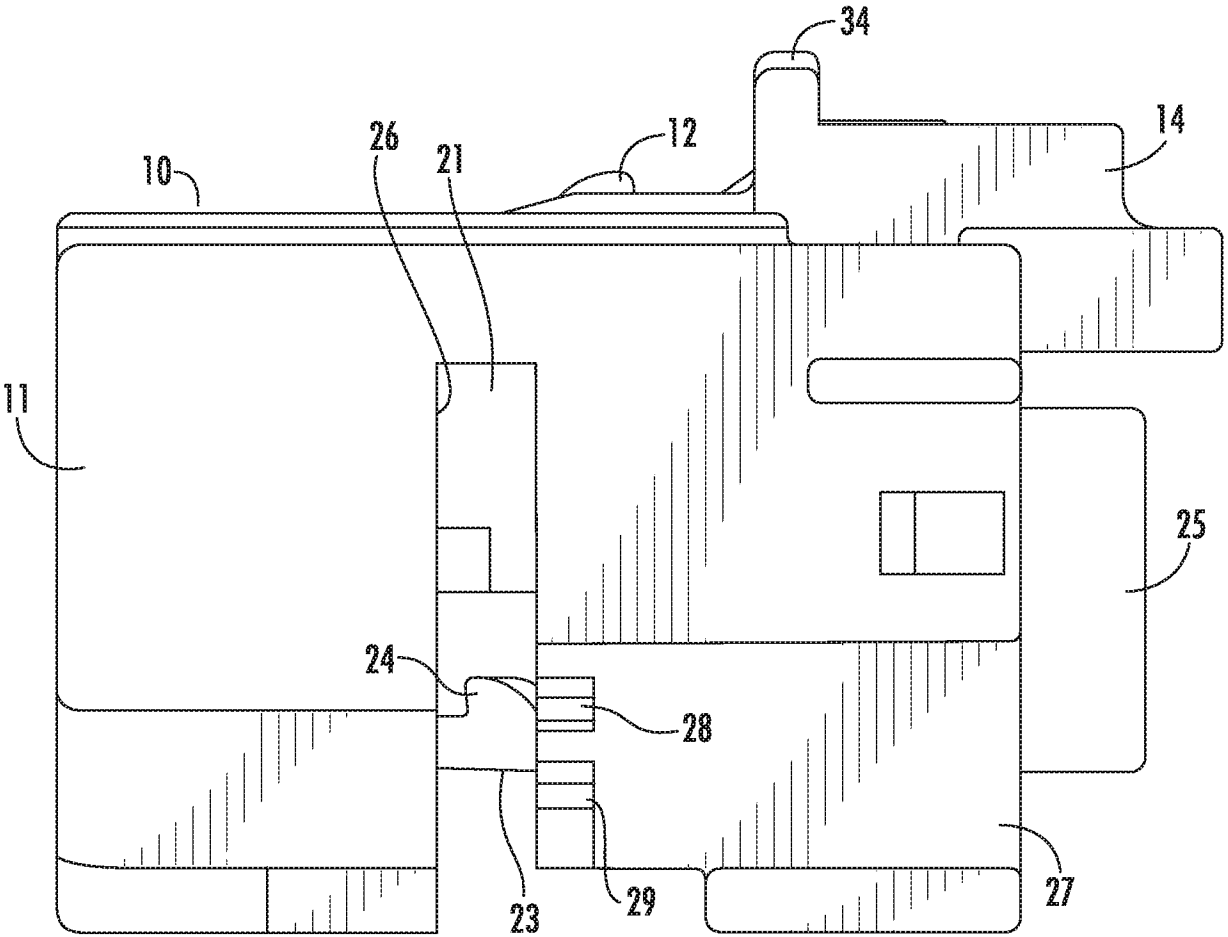
FIG. 8 is a side view of the connector housing.
Figure 9:
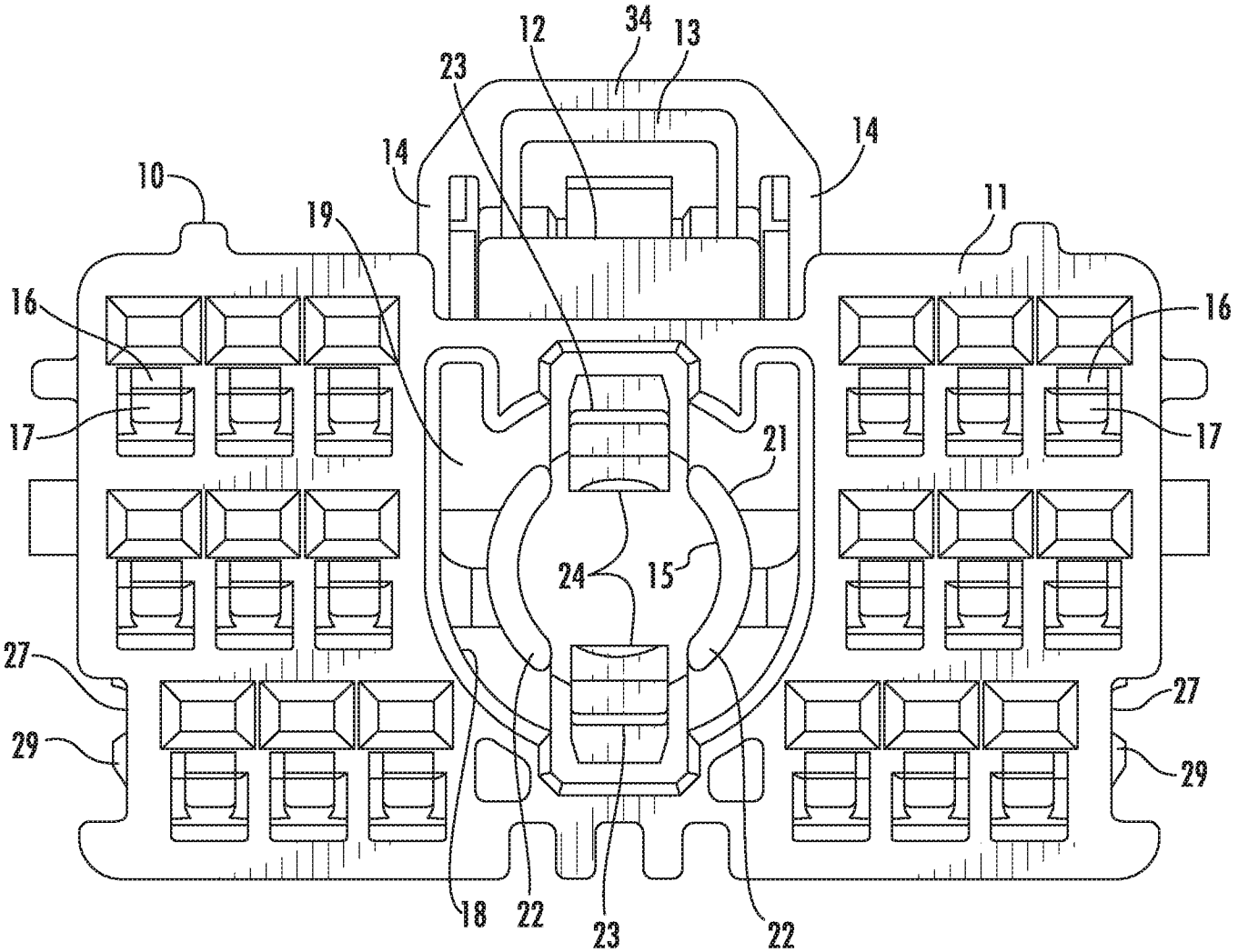
FIG. 9 is a front view of the connector housing.

The connector housing 10 is made of synthetic resin and includes a housing body 11 in the form of a rectangular block as shown in FIGS. 7 to 9. A deflectable lock arm 12 is cantilevered rearward from a laterally central part of the upper surface of the housing body 11. The lock arm 12 is resiliently locked to a lock receiving portion of the unillustrated mating connector housing and functions to hold the connector housings in a connected state when the connector housing 10 is connected to the mating connector housing. An unlocking portion 13 to be pressed at the time of separating the connector housings is provided to be slightly higher on a rear end part of the lock arm 12.

Figure 3:
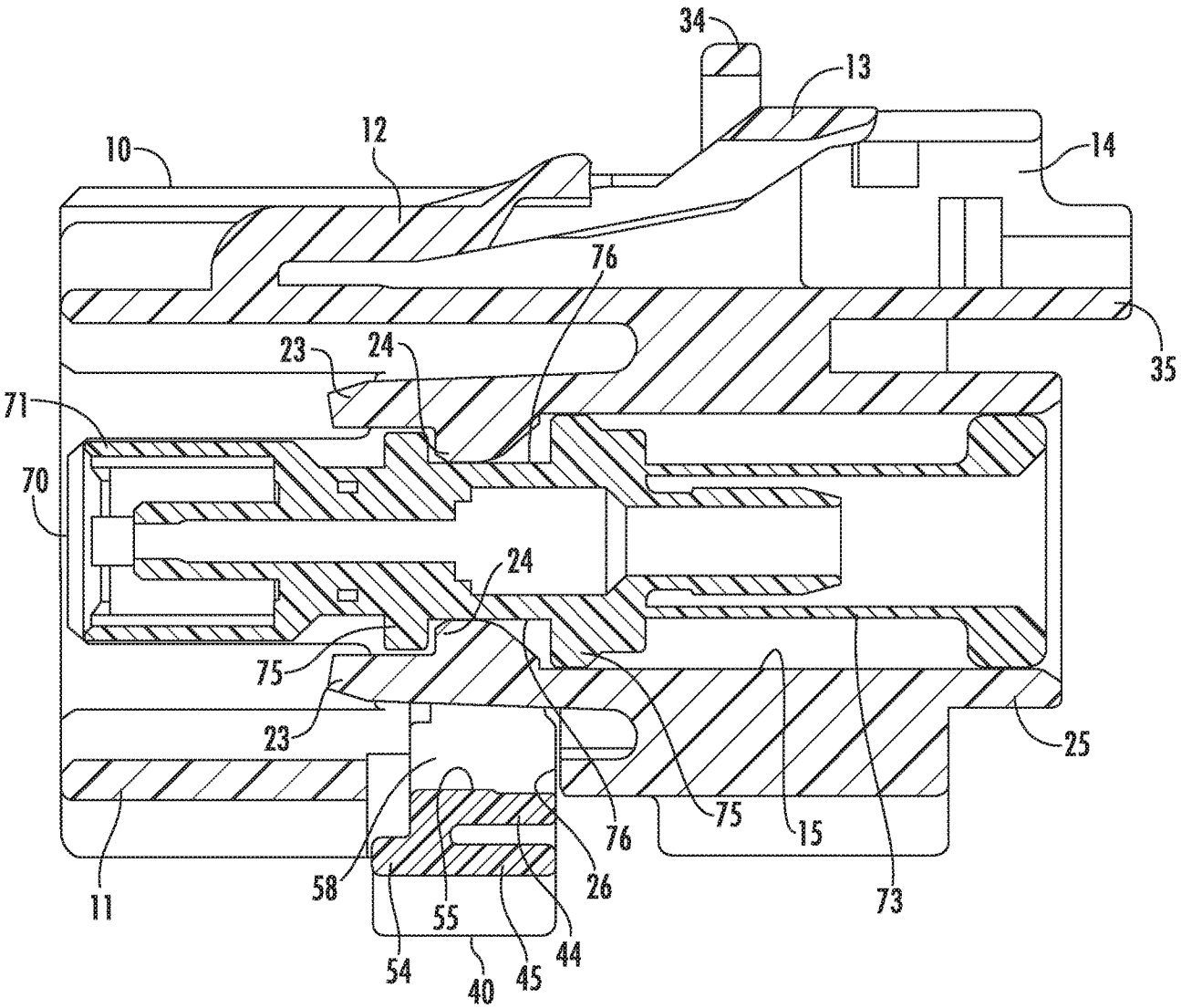
FIG. 3 is a section at a position corresponding to a deflection restricting portion of the retainer when the retainer is at the partial locking position with respect to the connector housing.

Further, two protection walls 14 stand to cover both left and right sides of the lock arm 12 on the upper surface of the housing body 11. An arched portion 34 is mounted between the upper ends of the protection walls 14 and crosses above the unlocking portion 13 to prevent an inadvertent unlocking operation from being performed on the unlocking portion 13. As shown in FIG. 3, rear parts of the protection walls 14 project farther rearward than the rear surface of the housing body 11 and a bottom wall 35 is mounted between the lower ends of the rear parts of the protection walls 14. An unillustrated connection detecting member is slid from behind into a space between the protection walls 14 and above the bottom wall 35.

As shown in FIGS. 7 and 9, a terminal inserting portion 15 penetrates in the front-rear direction through a substantially central part of the housing body 11 and cavities 16 are at both left and right sides of the terminal inserting portion 15. The cavities 16 are arranged so that the cavities 16 are aligned in the lateral direction in three stages in the vertical direction.

Figure 6:
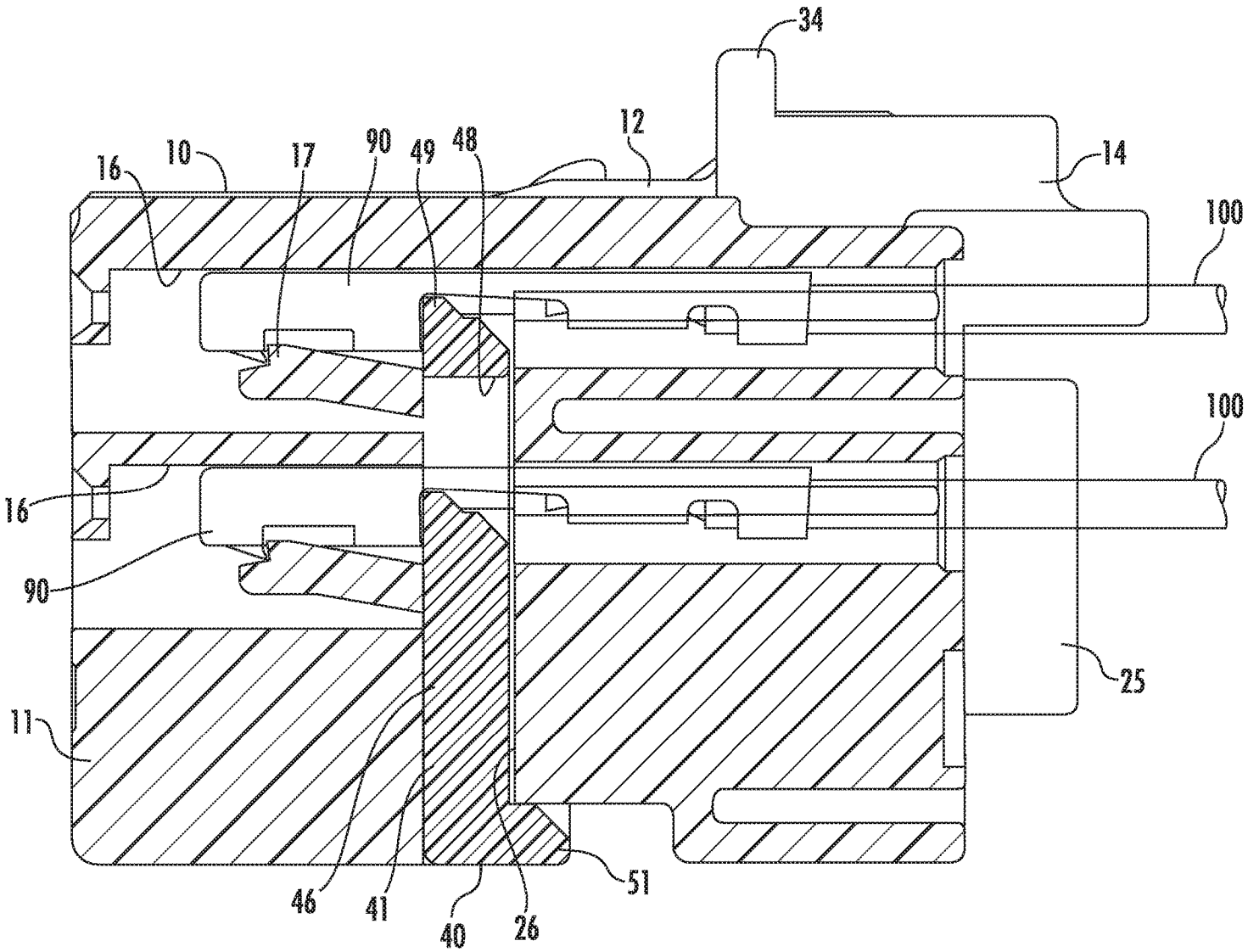
FIG. 6 is a section at a position corresponding to retaining portions of the retainer when the retainer is held at the full locking position with respect to the connector housing.

As shown in FIG. 6, a deflectable small locking lance 17 is cantilevered forward from the lower surface of the inner wall of each cavity 16. Each small terminal 90 is inserted into each cavity 16 from behind and the inserted small terminal 90 is locked resiliently and primarily retained by the small locking lance 17. Note that the small terminal 90 normally is connected to an end part of a wire 100 (unshielded wire).

As shown in FIG. 9, a connection space 18 is open forward around the outer periphery of the terminal inserting portion 15 in a laterally central part of the housing body 11. A tubular body of the unillustrated mating connector housing is fit into the connection space 18 when the connector housings are connected.

The housing body 11 includes an inner closed portion 19 for closing the back surface of the connection space 18. A fitting tube 21 projects forward from the inner closed portion 19 and is provided inside the connection space 18. The fitting tube 21 is be fit into the tubular body. Further, a front part of the terminal inserting portion 15 is defined by the fitting tube 21.

The fitting tube 21 includes left and right curved walls 22. Deflectable upper and lower locking lances 23 are cantilevered forward from the inner closed portion 19 and are interposed between both upper and lower ends of the curved walls 22. The upper and lower locking lances 23 are identical and are slightly larger than the small locking lances 17. Locking projections 24 are formed on tip parts of the locking lances 23 and face each other.

A tubular portion 25 is disposed at a position opposite to the fitting tube 21 across the inner closed portion 19 in the housing body 11. The tubular portion 25 is a cylinder projecting rearward from the inner closed portion 19 and includes a part projecting farther rearward than the rear surface of the housing body 11. A rear part side of the terminal inserting portion 15 is defined by the tubular portion 25. Thus, the terminal inserting portion 15 extends in the front-rear direction from the inside of the fitting tube 21 to the inside of the tubular portion 25 and penetrates through the inner closed portion 19 halfway through. The terminal fitting 70 is inserted into the terminal inserting portion 15 from behind.

Figure 11:
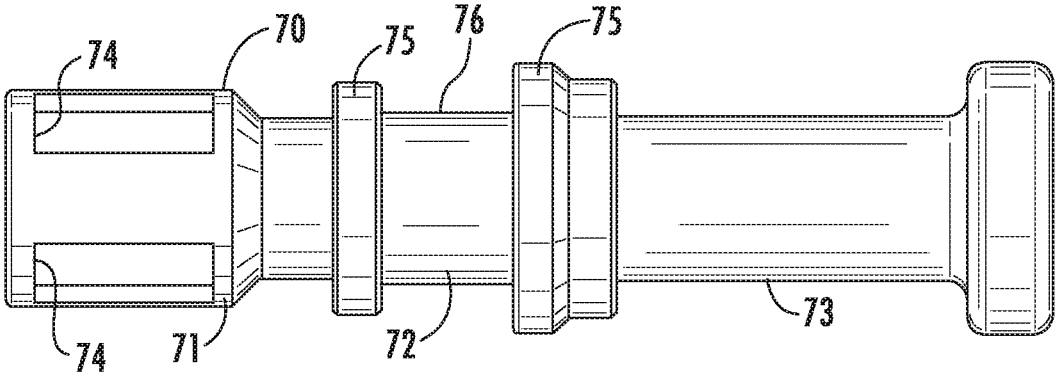
FIG. 11 is a side view of a terminal.

The terminal fitting 70 is made of electrically conductive metal and, as shown in FIG. 11, is composed of a connecting portion 71, a coupling 72 connected to and behind the connecting portion 71 and a crimping portion 73 connected to and behind the coupling 72, and configured to have a larger size than the small-size terminals 90.

The crimping portion 73 is a rearwardly open barrel open that is crimped to an end of an unillustrated coaxial cable. The connecting portion 71 is connected electrically to a mating terminal fitting accommodated in the unillustrated mating connector housing when the connector housings are connected. The connecting portion 71 has inner and outer double cylinders and includes slits 74 in an outer tube part.

Two jaws 75 protrude over the entire circumference on the outer peripheral surface (outer surface) of the coupling 72 while being spaced in the front-rear direction, and an annular groove 76 is defined between the jaws 75. As shown in FIG. 3, when the terminal fitting 70 is inserted to a proper depth into the terminal inserting portion 15, the locking projections 24 of the locking lances 23 resiliently enter the groove 76 from upper and lower sides and the terminal fitting 70 is retained primarily.

Figure 10:
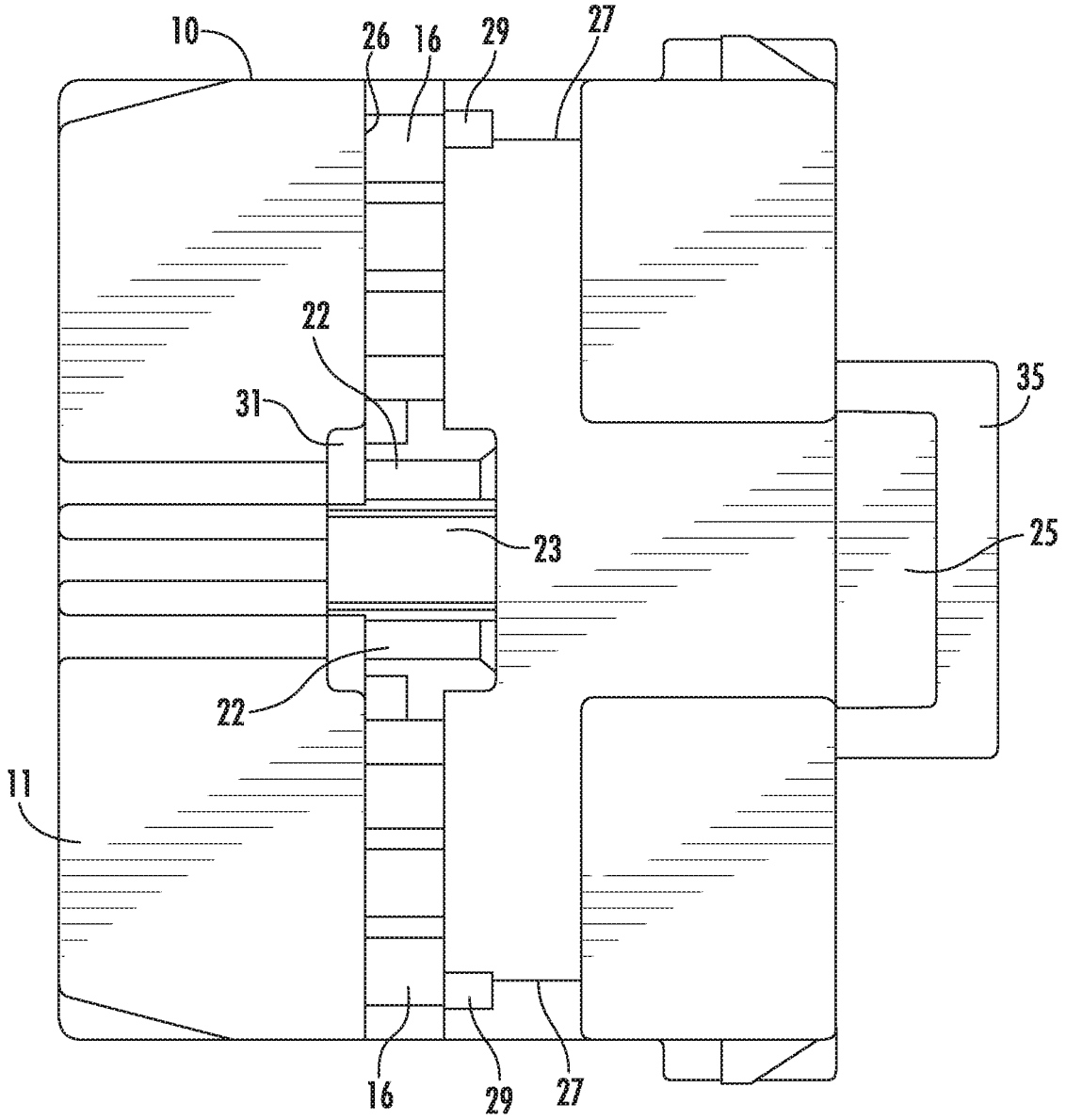
FIG. 10 is a bottom view of the connector housing.

As shown in FIGS. 8 and 10, a retainer mounting hole 26 is provided in a middle part of the housing body 11 in the front-rear direction and is open in the lower surface and both side surfaces. The retainer mounting hole 26 communicates with each cavity 16 and the terminal inserting portion 15 in a direction intersecting the front-rear direction. The locking lances 23 and the fitting tube 21 are arranged to cross the retainer mounting hole 26. As shown in FIG. 8, the locking projection 24 of the lower locking lance 23 can be seen laterally through the retainer mounting hole 26.

Recessed parts 27 are provided in lower parts of both side surfaces of the housing body 11 and are recessed slightly from upper parts. A full locking rib 28 and a partial locking rib 29 are provided one above the other in the vertical direction on a rear edge part of the opening of the retainer mounting hole 26 in each recessed part 27 of the housing body 11. The full locking rib 28 is located above the partial locking rib 29.

As shown in FIG. 10, an angular recess 31 is provided in a laterally central part of the lower surface of the housing body 11. The recess 31 is formed by cutting off a front end part of the opening of the retainer mounting hole 26 in the lower surface of the housing body 11 and communicates with the retainer mounting hole 26. The back surface (inner upper surface) of the recess 31 is divided at a position corresponding to the lower locking lance 23.

Figure 1:
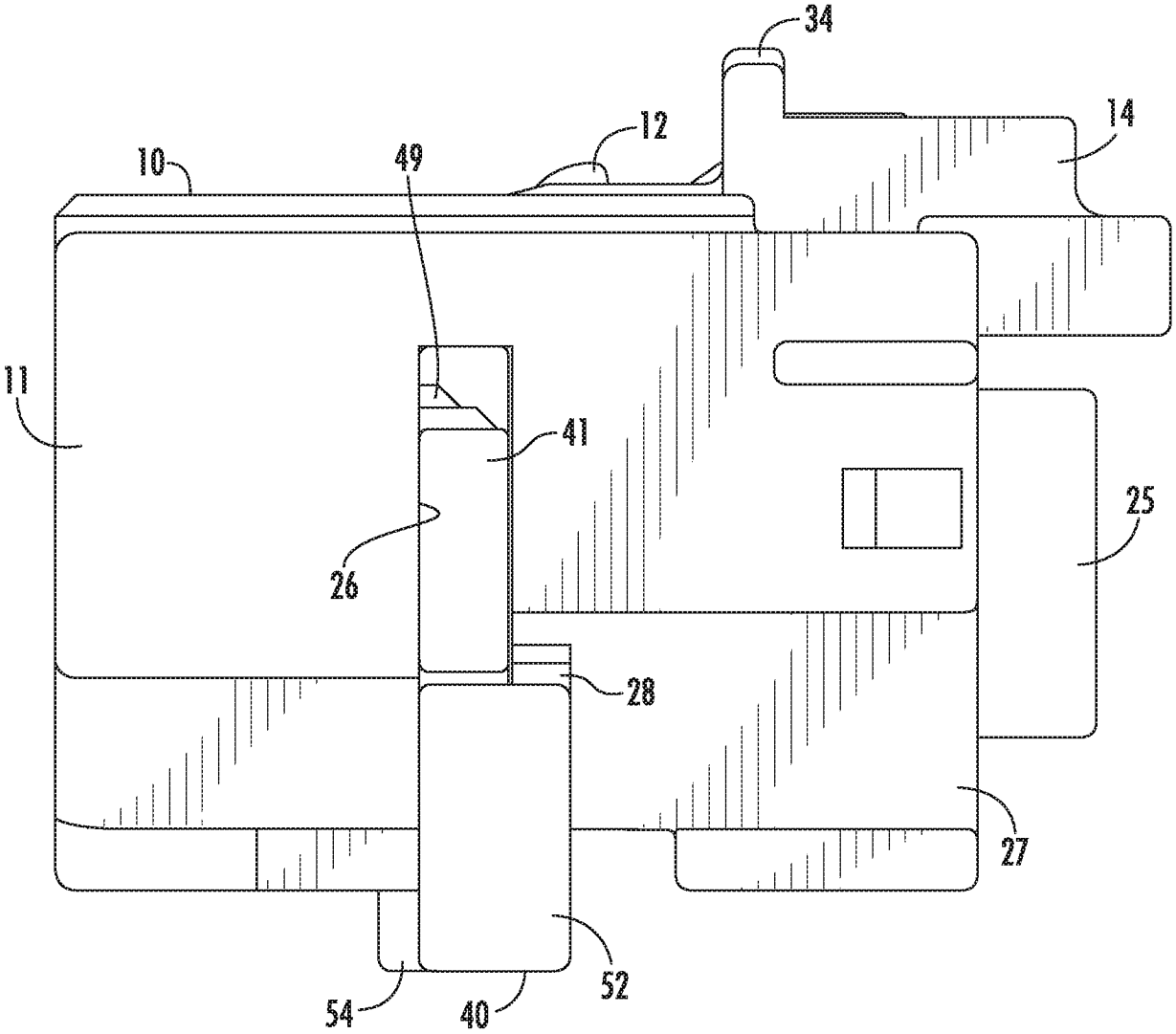
FIG. 1 is a side view showing a state where a retainer is held at a partial locking position with respect to a connector housing in a connector according to an embodiment of the invention.
Figure 2:
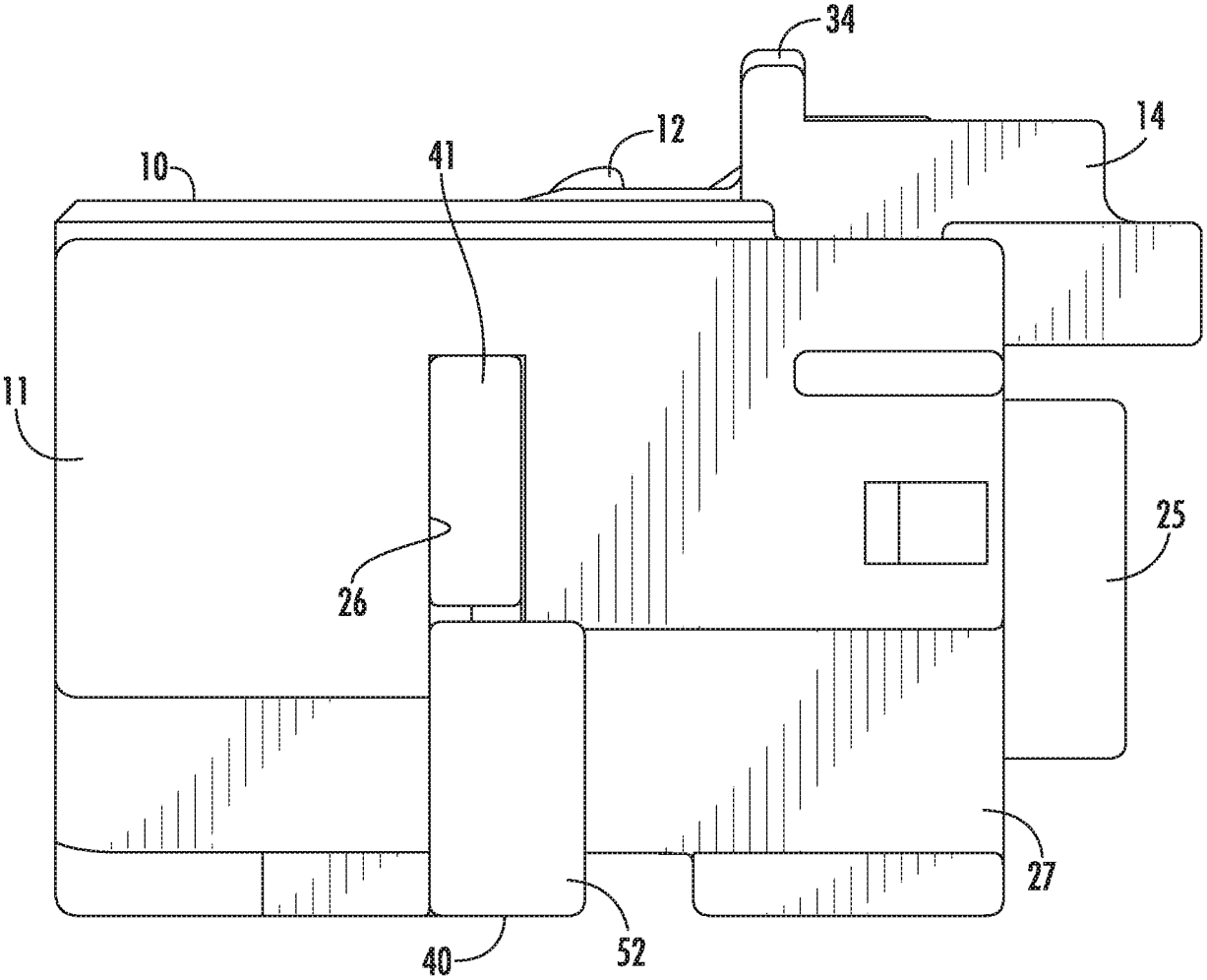
FIG. 2 is a side view showing a state where the retainer is held at a full locking position with respect to the connector housing.
Figure 12:
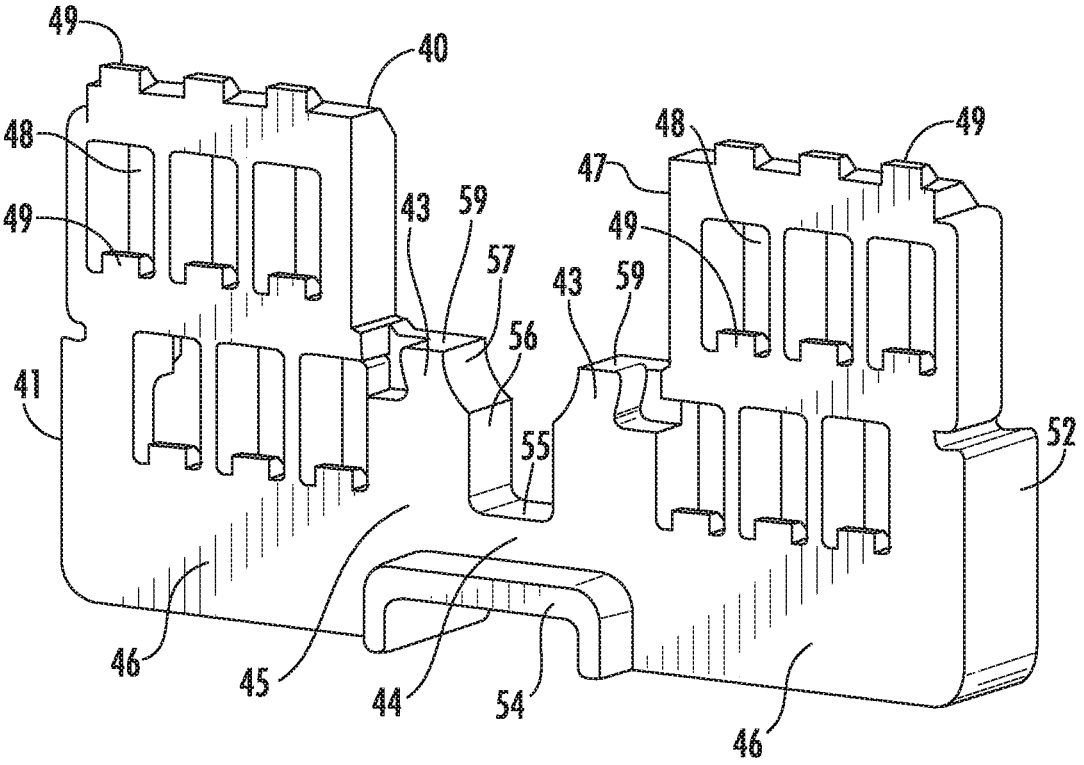
FIG. 12 is a perspective view of the retainer.
Figure 13:
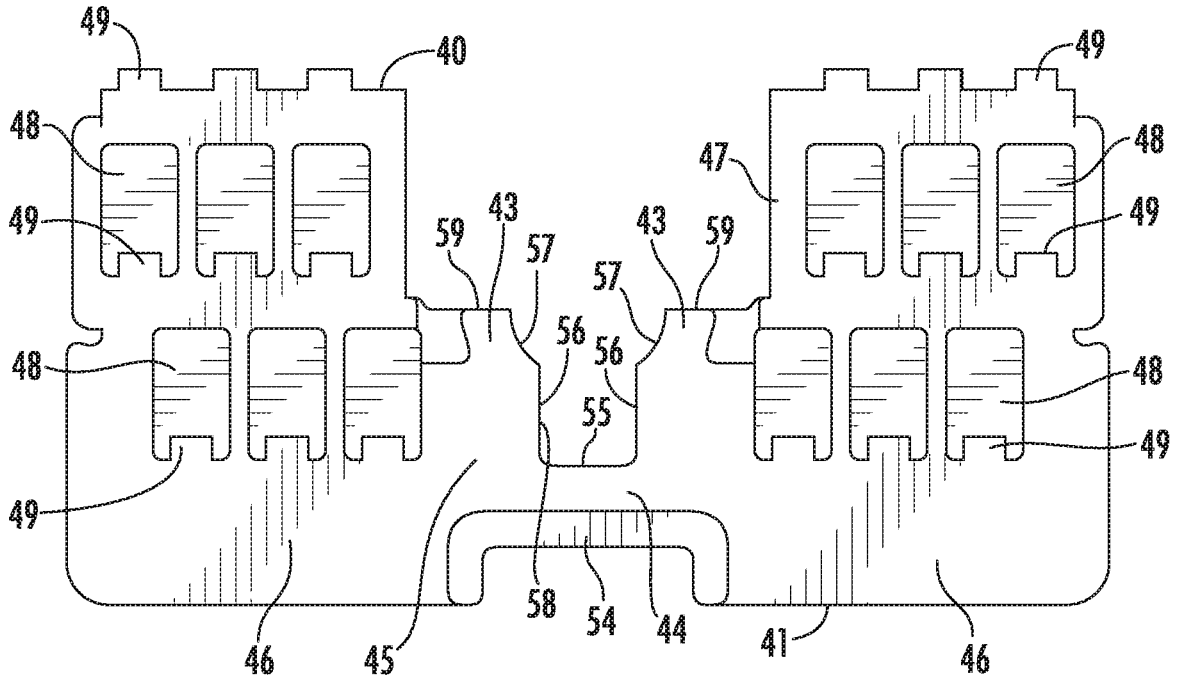
FIG. 13 is a front view of the retainer.
Figure 14:
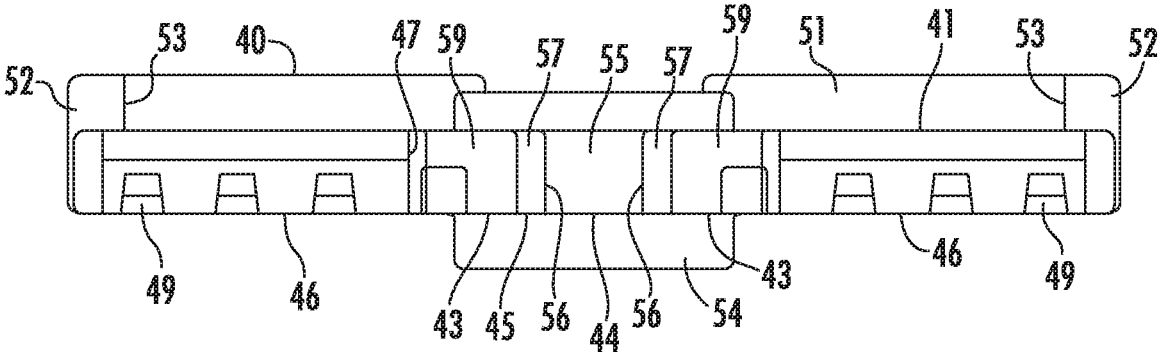
FIG. 14 is a plan view of the retainer.

The retainer 40 is made of synthetic resin and includes, as shown in FIGS. 12 to 14, a retainer body 41 in the form of a flat plate. The retainer 40 is inserted into the retainer mounting hole 26 through an opening in the lower surface of the housing body 11 with the plate surfaces of the retainer body 41 substantially aligned with the vertical direction, and vertically movable to a partial locking position where the retainer 40 is inserted shallowly in the housing body 11 and a full locking position where the retainer 40 is inserted to a proper depth, deeper than at the partial locking position, in the housing body 11. At the partial locking position, the lower surface of the retainer 40 projects down from the lower surface of the housing body 11, as shown in FIG. 1. At the full locking position, the retainer body 41 is substantially entirely inserted in the retainer mounting hole 26 and the lower surface of the retainer 40 is substantially flush with the lower surface (excluding the recess 31) of the housing body 11 or retracted into the retainer mounting hole 26, as shown in FIG. 2.

As shown in FIGS. 13 and 14, the retainer body 41 is composed of first and second acting portions 45 and 46. The first acting portion 45 includes later-described supports 43 and a deflection restricting portion 44 in a laterally central part and configured to directly or indirectly act on the terminal fitting 70. The second acting portions 46 are at both left and right sides of the first acting portion 45 and are configured to act on the respective small terminals 90, and are bilaterally symmetrical. A recess 47 for allowing the lower locking lance 23 and the fitting tube 21 to escape is provided to be open up at a position between the second acting portions 46 and the first acting portion 45.

Each of the second acting portions 46 is provided with through holes 48 communicating with the respective cavities 16 in the middle and lower stages at the full locking position. Each through hole 48 is a rectangular window open in both front and rear surfaces of the retainer body 41, and a retaining portion 49 projects on an inner lower surface. The upper ends of the second acting portions 46 are arranged to face the respective cavities 16 in the upper stage at the full locking position, and similar retaining portions 49 are provided to project at positions corresponding to the respective cavities 16 in the upper stage. When the retainer 40 is at the full locking position, each retaining portion 49 is arranged to be retracted from the corresponding cavity 16. As the retainer 40 reaches the full locking position, each retaining portion 49 enters the corresponding cavity 16 to face the small terminal 90 from behind, thereby secondarily locking the small-size terminal 90.

As shown in FIG. 14, a laterally extending base rib 51 projects on the lower end of the rear surface of each of the second acting portions 46. Further, a vertically extending side rib 52 protrudes on a lower part of the outer side of the rear surface of each of the second acting portions 46. The lower end of the side portion 52 is integrally coupled to the base portion 51. The side portion 52 is thinner than the base portion 51 and deflectable and deformable, and a claw-like locking portion 53 is provided to project on an upper part of the inner surface. With the retainer 40 mounted in the housing body 11, the side portions 52 are arranged to face the recessed parts 27 of the housing body 11.

Further, when the retainer 40 is at the partial locking position, the locking portions 53 are located between the partial locking portions 29 and the full locking portions 28 of the housing and the retainer 40 is held in a state where movements with respect to the housing are restricted. When a pushing force toward the full locking position is applied to the retainer 40, the locking portions 53 move onto the full locking portions 28 while the side portions 52 are deflected, and the retainer 40 is held at the full locking position in a state where a return movement to the partial locking position is restricted.

As shown in FIGS. 12 and 13, the first acting portion 45 includes the short deflection restricting portion 44 in a laterally central part and the tall supports 43 at both left and right sides of the deflection restricting portion 44. The first acting portion 45 is arranged substantially at the same position as the second acting portions 46 in the front-rear direction and is configured to have substantially the same width in the front-rear direction as the second acting portions 46.

Figure 4:
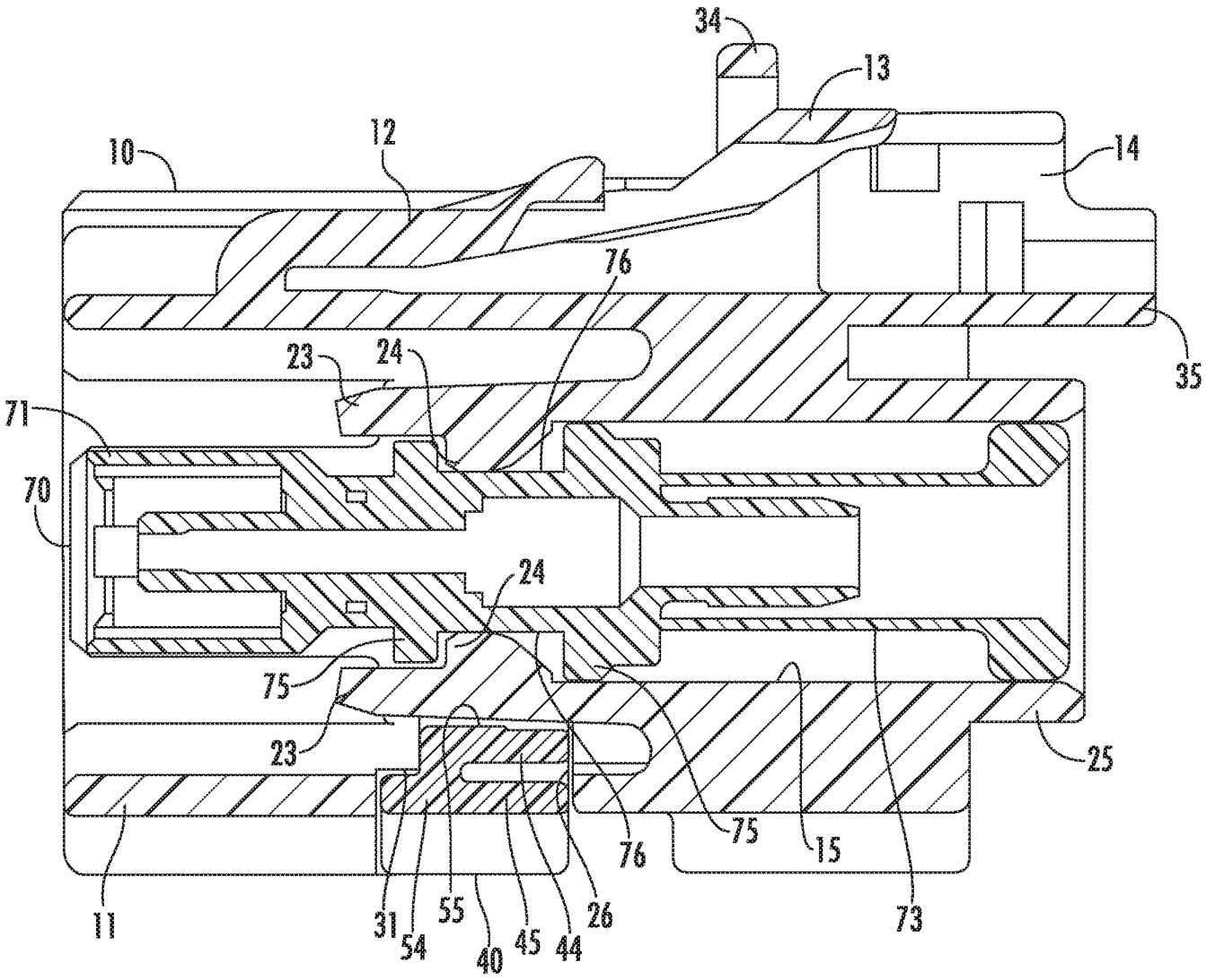
FIG. 4 is a section at a position corresponding to the deflection restricting portion of the retainer when the retainer is at the full locking position with respect to the connector housing.

The lower end of the first acting portion 45 is slightly higher than those of the second acting portions 46. A U-shaped fitting rib 54 borders an area from the lower end of the front surface of the first acting portion 45 to the lower ends of the front surfaces of the second acting portions 46. When the retainer 40 reaches the full locking position, the fitting protrusion 54 is fit into the recess 31 of the housing body 11 from below and is arranged to contact the back surface (inner upper surface) of the recess 31, as shown in FIG. 4. Thus, a mounting posture of the retainer 40 at the full locking position is corrected. Further, by reinforcing the first acting portion 45 by the fitting protrusion 54, the retainer 40 can avoid a situation where the first acting portion 45 (between the second acting portions 46) is bent or broken.

As shown in FIG. 13, the upper surface of the deflection restricting portion 44 serves as a deflection restricting surface 55 that is flat along the lateral direction between the supports 43. One side part of each of the supports 43 along a standing direction is integrated with the corresponding second acting portion 46 over the entire height and the other side part includes a guide surface 56 serving as a steep wall extending substantially perpendicularly up from a side end of the deflection restricting surface 55 and an arcuate retracted surface 57 extending from the upper end of the guide surface 56 to a supporting surface 59 to be described later. The guide surfaces 56 are parallel to each other, and a separation width between the guide surfaces 56 is slightly larger than a lateral dimension of the locking lances 23. A space between the guide surfaces 56 defines a deflection space 58 for allowing the deflection of the lower locking lance 23 when the retainer 40 is at the partial locking position. The retracted surfaces 57 have a concentric arc shape curved substantially with the same curvature as the fitting tube 21. When the retainer 40 is at the full locking position, the retracted surfaces 57 are arranged along the corresponding curved walls 22.

The upper surfaces of the supports 43 define the supporting surfaces 59 flat along the lateral direction between the second acting portions 46 and the retracted surfaces 57. As described above, the supporting surfaces 59 are located above the deflection restricting surface 55 via the guide surfaces 56 and the retracted surfaces 57. Note that a recess 47 is defined by the supporting surfaces 59, the retracted surfaces 57, the guide surfaces 56 and the deflection restricting surface 55.

The connector according to this embodiment is structured as described above. Next, functions and effects of this embodiment are described.

In assembling, the retainer 40 is first held at the partial locking position with respect to the connector housing 10. At the partial locking position, the lower locking lance 23 is arranged in the deflection space 58 of the retainer 40 (see FIG. 3) and both side ends of the lower locking lance 23 are arranged proximate to the facing guide surfaces 56. Further, at the partial locking position, the deflection restricting surface 55 of the retainer 40 is separated downward from the lower surface of the lower locking lance 23 and arranged to face this lower surface substantially in parallel, and the supporting surfaces 59 of the retainer 40 are separated down from the back surface of the groove 76 of the terminal fitting 70 and arranged to face this back surface substantially in parallel.

In the above state, the small terminal 90 is inserted into each cavity 16 of the housing body 11 and primarily retained and locked by the small locking lance 17. Further, before or after this operation, the terminal fitting 70 is inserted into the terminal inserting portion 15 of the housing body 11.

In the process of inserting the terminal fitting 70 into the terminal inserting portion 15, the connecting portion 71 of the terminal fitting 70 interferes with the locking projections 24 of the upper and lower locking lances 23 to deflect and deform the locking lances 23. At this time, the connection space 18 functions as a deflection space for allowing the deflection of the upper locking lance 23. Further, the lower locking lance 23 is deflected and deformed into the deflection space 58 of the retainer 40 and the deflection thereof is guided by the guide surfaces 56 located at both sides. The upper and lower locking lances 23 resiliently return when the terminal fitting 70 is inserted to the proper depth into the terminal inserting portion 15, and the locking projections 24 of the locking lances 23 are fit substantially simultaneously into the groove 76 of the terminal fitting 70 from both upper and lower sides. In this way, as shown in FIG. 3, the locking projections 24 of the locking lances 23 are arranged to contact the front jaw 75 and the terminal fitting 70 is retained primarily and locked by the locking lances 23.

Subsequently, the retainer 40 is pushed to the full locking position. When the retainer 40 reaches the full locking position, each retaining portion 49 enters the corresponding cavity 16 and is arranged to contact the small terminal 90 and the small terminal 90 is secondarily retained and locked as shown in FIG. 6.

Further, when the retainer 40 reaches the full locking position, the deflection restricting surface 55 of the retainer 40 is arranged to contact the lower surface of the lower locking lance 23 as shown in FIG. 4. In this way, the deflection of the lower locking lance 23 is restricted and the terminal fitting 70 is retained and locked secondarily.

Figure 5:
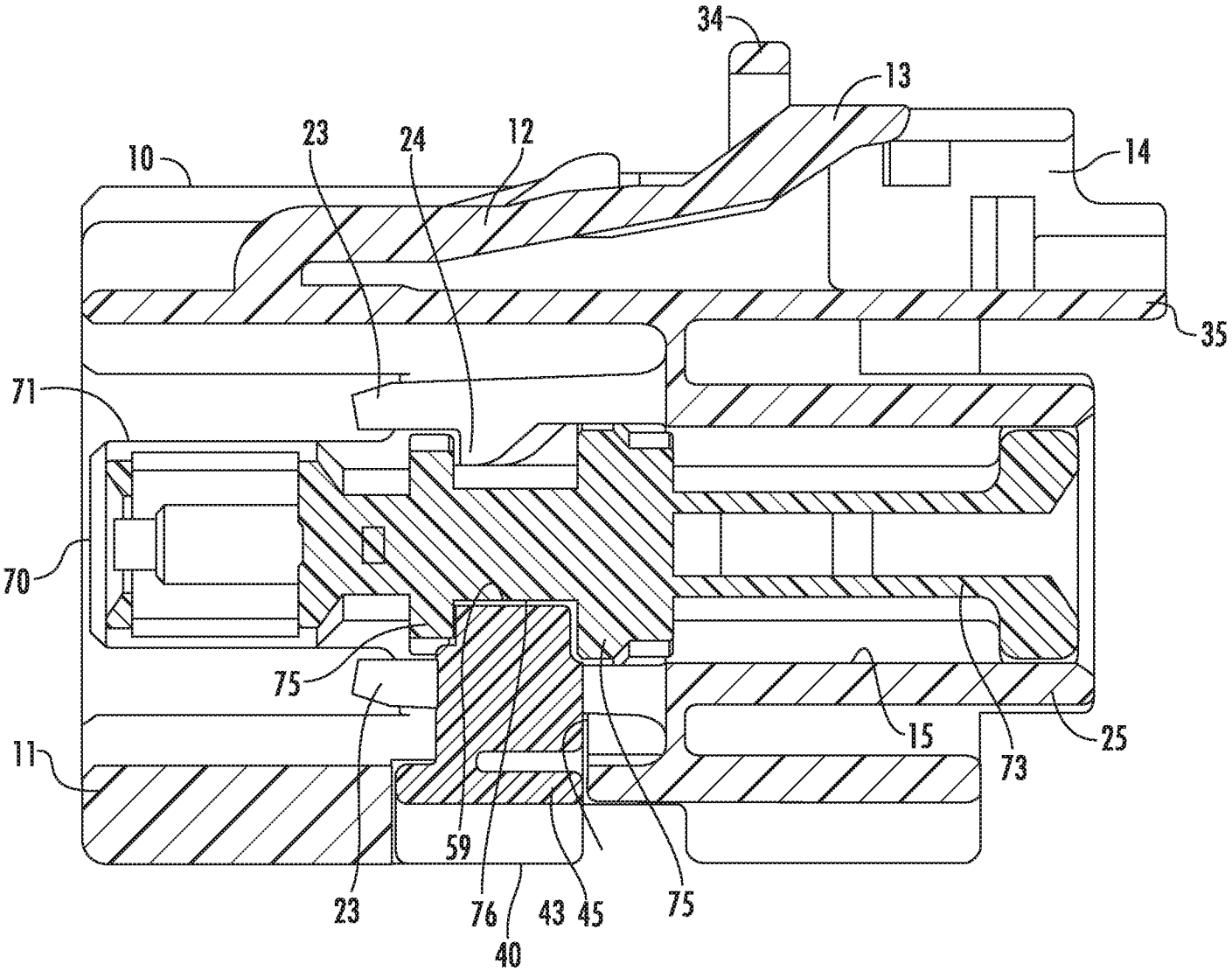
FIG. 5 is a section at a position corresponding to supports of the retainer when the retainer is held at the full locking position with respect to the connector housing.

Further, when the retainer 40 reaches the full locking position, the retracted surfaces 57 of the supports 43 are arranged along the fitting tube 21 and upper parts of the supports 43 are fit and inserted into the groove 76 of the terminal fitting 70. At this time, the locking projection 24 is arranged between the upper parts of the both supports 43. Further, as shown in FIG. 5, the upper parts of the both supports 43 are arranged to be able to contact with the respective front and rear jaws 75. Thus, the terminal fitting 70 is retained tertiarily and positioned in the front-rear direction. Further, the supporting surfaces 59 of the supports 43 are arranged to contact the back surface of the grooves 76 of the terminal fitting 70 and the tilt of the terminal fitting 70 toward a side where the locking lance 23 is located (lower side) is restricted. Thereafter, the connector housing 10 is connected to the mating connector housing and the terminal fitting 70 is electrically connected to a corresponding mating terminal fitting.

Figure 15:
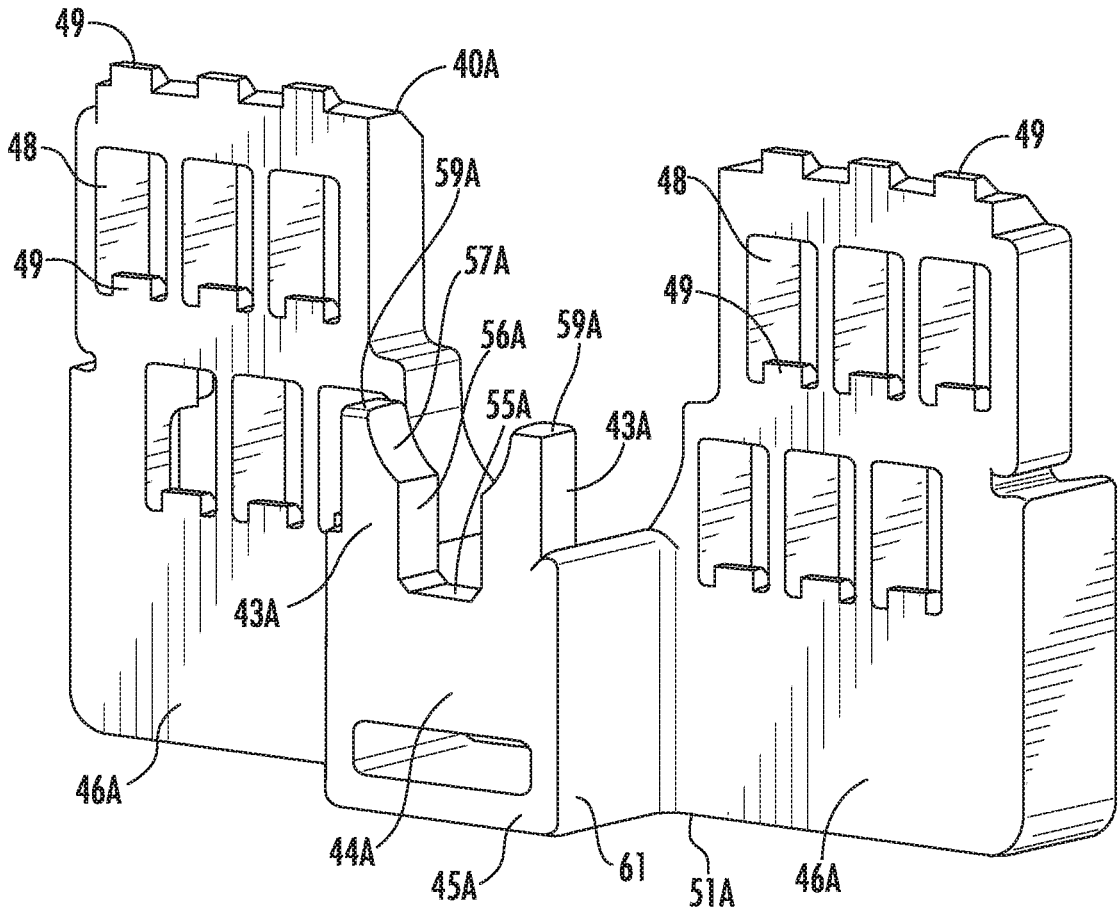
FIG. 15 is a perspective view of a mating retainer.

FIG. 15 shows a mating retainer 40A to be mounted into the mating connector housing to retain the unillustrated mating terminal fitting. In the mating retainer 40A, a first acting portion 45A is shifted forwardly of left and right second acting portions 46A. In this point, the retainer 40A differs from the retainer 40. Note that the mating terminal fitting is a male terminal fitting having a tab projecting forward.

The second acting portions 46A are coupled to each other via a rib-like base portion 51A extending along the lateral direction. Links 61 are provided between the second acting portions 46A and the first acting portion 45A. The links 61 has a substantially angular U-shaped cross-section to link the second acting portions 46A and the first acting portion 45A on both left and right sides and link the base 51A and the first acting portion 45A on a lower side. Thus, a housing part in the form of a rectangular box open upward and rearward is configured by the first acting portion 45A and the links 61 in a laterally central part of the mating retainer 40A.

The first acting portion 45A has substantially the same structure as the first acting portion 45 of the retainer 40 and includes two supports 43A at both left and right sides of a deflection restricting portion 44A, and the supporting portions 43A and the deflection restricting portion 44A are arranged substantially at the same position in the front-rear direction. The deflection restricting portion 44A has a deflection restricting surface 55A on an upper surface, and the both supporting portions 43A have guide surfaces 56A, retracted surfaces 57A and supporting surfaces 59A.

The mating retainer 40A structured as described above can also cope with a case where a locking position and a supporting position are shifted in the front-rear direction. Further, since the mating retainer 40A includes the housing part composed of the first acting portion 45A and the linking portions 61 in the laterally central part, a situation where the first acting portion 45A is bent or broken can be more reliably avoided.

Other embodiments are briefly described below.

The retainer may be configured to reach the full locking position in one step and be held in the connector housing without being held at the partial locking position with respect to the connector housing.

A plurality of terminal fittings may be provided and the respective terminal fittings may be inserted into a plurality of terminal inserting portions provided in the connector housing.

The terminal fitting may not be provided with the groove portion and the supporting surfaces of the supporting portions may be arranged to be able to support the terminal fitting.

The terminal fitting may be connected to a normal wire (unshielded wire) instead of the coaxial cable.

The retainer may be of a non-hybrid type to retain only the terminal fitting, but have no structure of retaining the small-size terminals.

The retainer mounting hole may be open only in one surface of the housing body serving as an insertion opening for the retainer without being open in both side surfaces of the housing body.

LIST OF REFERENCE SIGNS

10 . . . connector housing
11 . . . housing body

15 . . . terminal inserting portion
16 . . . cavity
26 . . . retainer mounting hole
40 . . . retainer
40A . . . mating retainer
43, 43A . . . support
44, 44A . . . deflection restricting portion
56, 56A . . . guide surface
58 . . . deflection space
59, 59A . . . supporting surface
70 . . . terminal fitting
76 . . . groove
90 . . . small terminal

What is claimed is:

1. A connector, comprising:

a terminal fitting having opposite front and rear ends, spaced apart front and rear front jaws projecting out on the terminal fitting at positions between the front and rear ends and a groove between the front and rear jaws;

a connector housing including a terminal inserting portion into which the terminal fitting is inserted, a deflectable locking lance projecting into the terminal inserting portion and configured to oppose a surface of the front jaw facing the rear jaw for retaining and locking the terminal fitting, and a retainer mounting hole communicating with the terminal inserting portion and open in one surface of the housing at a position spaced from the front and rear ends of the housing and facing in a direction intersecting an inserting direction of the terminal fitting; and a retainer to be inserted into the retainer mounting hole through an opening in the one surface of the connector housing and in the direction intersecting the inserting direction of the terminal fitting;

the retainer including a deflection restricting portion configured to restrict the deflection of the locking lance by entering a deflection space for the locking lance with the retainer inserted to a proper depth in the retainer mounting hole and first and second supports configured for supporting the terminal fitting by being located to contact the front and rear jaws of the terminal fitting and a bottom surface of the groove when the retainer is inserted to the proper depth.

2. The connector of claim 1, wherein the connector housing includes a cavity into which a small terminal having a smaller size than the terminal fitting is inserted, the retainer mounting hole also communicates with the cavity, and the retainer includes a retaining portion configured to retain and lock the small terminal with the retainer inserted to the proper depth in the retainer mounting hole.

3. A connector, comprising:

a connector housing including a terminal inserting portion into which a terminal fitting is inserted, a deflectable locking lance projecting into the terminal inserting portion and configured to retain and lock the terminal fitting, and a retainer mounting hole communicating with the terminal inserting portion and open in one surface facing in a direction intersecting an inserting direction of the terminal fitting; and a retainer to be inserted into the retainer mounting hole through an opening in the one surface of the connector housing, the retainer including a deflection restricting portion configured to restrict the deflection of the locking lance by entering a deflection space for the locking lance with the retainer inserted to a proper depth in the retainer mounting hole and two supports arranged respectively at opposite sides of the deflection restricting portion configured for supporting the terminal fitting from both side by being located to contact the terminal fitting, wherein:

the retainer is movable with respect to the connector housing to a partial locking position where the retainer is inserted shallowly in the retainer mounting hole and a full locking position where the retainer is inserted to a proper depth in the retainer mounting hole; and the supports include supporting surfaces at positions higher than the deflection restricting portion and steep wall surfaces extending from a side where the deflection restricting portion is located to the supporting surfaces, the deflection space being configured to allow the deflection of the locking lance at the partial locking position between the wall surfaces of the supports, and the deflection of the locking lance is guided by the wall surfaces.

4. The connector of claim 3, wherein the terminal fitting includes a groove on an outer surface, and the support is fit into the groove to restrict a displacement of the terminal fitting in the inserting direction when the retainer is inserted to the proper depth into the retainer mounting hole.

* * * * *